US009469962B1

(12) United States Patent
LeBlanc

(10) Patent No.: US 9,469,962 B1
(45) Date of Patent: Oct. 18, 2016

(54) PREFAB LIFT STATION

(71) Applicant: Denis LeBlanc, Grand-Barachois (CA)

(72) Inventor: Denis LeBlanc, Grand-Barachois (CA)

( * ) Notice: Subject to any disclaimer, the term of this patent is extended or adjusted under 35 U.S.C. 154(b) by 0 days.

(21) Appl. No.: 14/545,852

(22) Filed: Jun. 29, 2015

Related U.S. Application Data

(60) Provisional application No. 62/125,742, filed on Jan. 30, 2015.

(51) Int. Cl.
*E02D 27/32* (2006.01)
*E02D 27/01* (2006.01)
*E02D 29/00* (2006.01)
*E03F 5/22* (2006.01)

(52) U.S. Cl.
CPC ..... *E02D 27/32* (2013.01); *E02D 27/016* (2013.01); *E02D 29/10* (2013.01); *E03F 5/22* (2013.01)

(58) Field of Classification Search
CPC ... E02D 29/10; E02D 29/016; E02D 27/016; E02D 27/32
USPC ..... 137/363, 364, 371
See application file for complete search history.

(56) References Cited

U.S. PATENT DOCUMENTS 2,292,121 A * 8/1942 Hasenburger ..... E04F 17/08 137/358
D197,705 S 3/1964 Ross
3,592,564 A * 7/1971 Conery ..... F04D 29/607 222/385
3,938,545 A 2/1976 Nagy et al.
4,097,201 A * 6/1978 Nussbaum ..... F04B 47/06 417/360
D254,509 S 3/1980 Migchelbrink, Jr.
4,242,847 A 1/1981 Rezin
4,348,158 A * 9/1982 Wood ..... E03F 5/22 137/363
4,594,153 A 6/1986 Weis
4,805,360 A * 2/1989 Kuehnl ..... E04H 9/12 52/169.1
5,431,510 A * 7/1995 Reinert, Sr. ..... B64F 1/20 404/26
6,247,490 B1 * 6/2001 Mosher ..... E03B 5/00 137/363
6,644,342 B1 * 11/2003 Bogan ..... E02D 29/121 137/364
7,150,290 B1 * 12/2006 Smith ..... E03F 5/22 137/236.1
7,503,339 B1 3/2009 Bogan et al.
8,051,873 B2 11/2011 Mullen
8,347,912 B2 1/2013 Szuster et al.
8,740,576 B2 * 6/2014 Konnur ..... E03B 5/00 137/143
8,875,729 B1 * 11/2014 Bramble ..... F04D 13/068 137/362
2014/0261770 A1 * 9/2014 Weed ..... C02F 3/28 137/363
2014/0326332 A1 * 11/2014 Pasco ..... E03F 5/22 137/364

FOREIGN PATENT DOCUMENTS

CA 903178 6/1972
CA 905212 7/1972

* cited by examiner

*Primary Examiner* — Brian Glessner
*Assistant Examiner* — Paola Agudelo
(74) *Attorney, Agent, or Firm* — Mario Theriault

(57) ABSTRACT

The prefab lift station has a well casing including mechanical equipment therein and a horizontal upper rim. A foundation slab is mounted to the horizontal upper rim and covers the well casing. A building is mounted to the foundation slab. The foundation slab and the building are mounted offset from a center of the horizontal upper rim, to accommodate a hatch through the foundation slab in front of the building giving unrestricted access inside the well casing. A portion of the slab and a portion of the building are overhanging outside the horizontal upper rim. The foundation slab has a weightless volume incorporated therein for shifting a center of gravity of the foundation slab and the building to a region inside the horizontal upper rim of the well casing. The foundation slab and the instrument building are self-balanced on the well casing.

5 Claims, 5 Drawing Sheets

PREFAB LIFT STATION

This application claims the benefit of U.S. Provisional Patent Application No. 62/125,742, filed Jan. 30, 2015.

FIELD OF THE INVENTION

This invention pertains to wastewater lift stations, and more particularly, it pertains to prefab buildings that are readily mountable to the rim of a wastewater well casing.

BACKGROUND OF THE INVENTION

Wastewater lift stations are used to transfer sewage from a low level to a higher elevation. Several lift stations can be used along a sewage line to accommodate the topography of a municipality where a gravity flow to a wastewater treatment facility is not possible.

Wastewater and sewage lift stations are better known to the public because they are widely used. Such lift stations can be also used on other fluids or semi-fluid substances, and therefore, these stations are referred to herein as "lift stations".

Although several designs of lift stations have been developed in the past, the type that is of interest herein has two submersible pumps mounted in the bottom of a well casing. The valves, flow meter and air release valves are mounted directly above the well. When the well casing is relatively small, the directional valves and other mechanical equipment stand unprotected above the well. In some other small installations, the valves and piping from the pumps and back to an discharge pipe are enclosed in a small housing mounted over the rim of the well casing. These housings are precisely fitted to enclose the piping and control equipment without leaving any excessive space inside the housing.

In other more expensive installations, all the valves, piping, meters and control equipment are mounted aboveground in a separate instrument building located near the well casing. The instrument building is built on a concrete slab as close as possible from the well casing. Piping and electrical conduits are installed underground between the well casing and the instrument building. This type of lift stations is believed to be the most popular model in use.

Examples of lift stations of the prior art or their elements are described in the following publications:

U.S. Pat. DES 197,705 issued to D. S. Ross on Mar. 17, 1964;

U.S. Pat. DES 254,509 issued to R. J. Migchelbrink, on Mar. 18, 1980;

U.S. Pat. No. 3,938,545 issued to N. Nagy et al., on Feb. 17, 1976;

U.S. Pat. No. 4,242,847 issued to R. G. Rezin on Jan. 6, 1981;

U.S. Pat. No. 4,594,153 issued to F. G. Weis on Jun. 10, 1986;

U.S. Pat. No. 6,644,342 issued to T. D. Bogan et al., on Nov. 11, 2003;

U.S. Pat. No. 7,503,339 issued to T. D. Bogan et al. On Mar. 17, 2009;

U.S. Pat. No. 8,051,873 issued to R. J. Mullen on Nov. 8, 2011;

U.S. Pat. No. 8,347,912 issued to M. Szuster et al., on Jan. 8, 2013;

CA Patent 903,178 issued to J. W. Parks on Jun. 20, 1972;

CA Patent 905,212 issued to F. G. Weis on Jul. 18, 1972.

Because of the amount of piping and electrical conduits required between a well casing and the instrument building of a lift station, it is believed that there is a need in this field for a new arrangement that is easier to build and to service than the popular installations. For example, there is a need in this field for a instrument building that is located close to the submersible pumps, so that operation of the pumps can be heard by the same person working the valves or the switches in the instrument building.

It is often the case with lift stations, that the inlet or discharge pipe needs to be dug to, inspected or replaced. Few of such cases include failure of a pipe from frost, failure from corrosion, change in topography, and upgrades to larger pipe sizes. The slab supporting the instrument building of the prior art is generally located immediately over the discharge pipe. Any access to that pipe requires the removal of the instrument building and the breaking up of the concrete slab on which the building is mounted.

It is also believed that there is a need in that field for a new lift station which allows digging down to the inlet or discharge pipe without having to demolish and replace the station itself.

SUMMARY OF THE PRESENT INVENTION

In the present invention, there is provided a lift station wherein the instrument building sits atop the well casing, and uses the well casing as a support structure. Piping and conduit work are reduced to a minimum. Audible and visual monitoring of the operation of the lift station can be done by the person working the valves or switches in the instrument building of the lift station.

In a first aspect of the present invention, there is provided a prefab lift station comprising a well casing including a pump, conduits, piping and a horizontal upper rim. A foundation slab is mounted to the horizontal upper rim and covers the well casing. A walk-in type building is mounted to the foundation slab. The foundation slab and the building are mounted offset from a center of the horizontal upper rim, to accommodate a hatch in front of the building. The hatch is located immediately above a first vertical half of the well casing. The hatch gives unrestricted access inside the well casing. A portion of the slab and a portion of the building are overhanging outside the horizontal upper rim. The foundation slab has a weightless volume therein for shifting a center of gravity of the foundation slab and the building to a region inside the horizontal upper rim of the well casing. The building and foundation slab are in balance on the horizontal upper rim of the well casing.

In this arrangement, the opening of the hatch in front of the building is relatively large with one side thereof bordering the diameter of the rim of the well casing. The piping from the pumps extend straight up into the mechanical room of the building. This mechanical room is located immediately above a second vertical half of the well casing.

The electrical wiring and conduits which are more easily bent and formed as required, extend from the pumps through the mechanical room and into an electrical room overhanging the well casing.

The prefab lift station of the present invention can be mounted to relatively small well casings, having a diameter of 6, 7 or 8 feet for example. It will be appreciated that it can also be mounted to larger well casings.

The electrical room has a walk-in space therein. Such a walk-in space is advantageous for providing a sheltered enclosure for a worker to read meters, to write notes, to read a plan, to make a phone call, to wait for dispatched help, to wait for instructions, or to store tools. This electrical room is sufficiently large for meeting compliance requirements of the National Electrical Code.

With the center of gravity of the lift station according to the present invention adjusted to reside inside the well casing, or even near the center of the well casing, no tipping moment is applied to the well casing. This advantage is particularly appreciable with new installation where the soil is relatively soft, and leaning of the well casing must be prevented.

The foundation slab and instrument building are self-balancing on the well casing. Both the inlet pipe and discharge pipe can be dug to without demolishing the instrument building, or moving the foundation slab in any way. This represents a substantial saving in capital costs and time.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

A preferred embodiment of the prefab lift station according to the present invention is described herein with the aid of the accompanying drawings in which like numerals denote like parts throughout the several views.

The drawings presented herein are presented for convenience to explain the functions of all the elements included in the lift station according to the preferred embodiment of the present invention. Elements and details that are obvious to the person skilled in the art may not have been illustrated. Conceptual sketches have been used to illustrate elements that would be readily understood in the light of the present disclosure. These drawings are not fabrication drawings and should not be scaled.

DESCRIPTION OF THE PREFERRED EMBODIMENT

Figure 1:
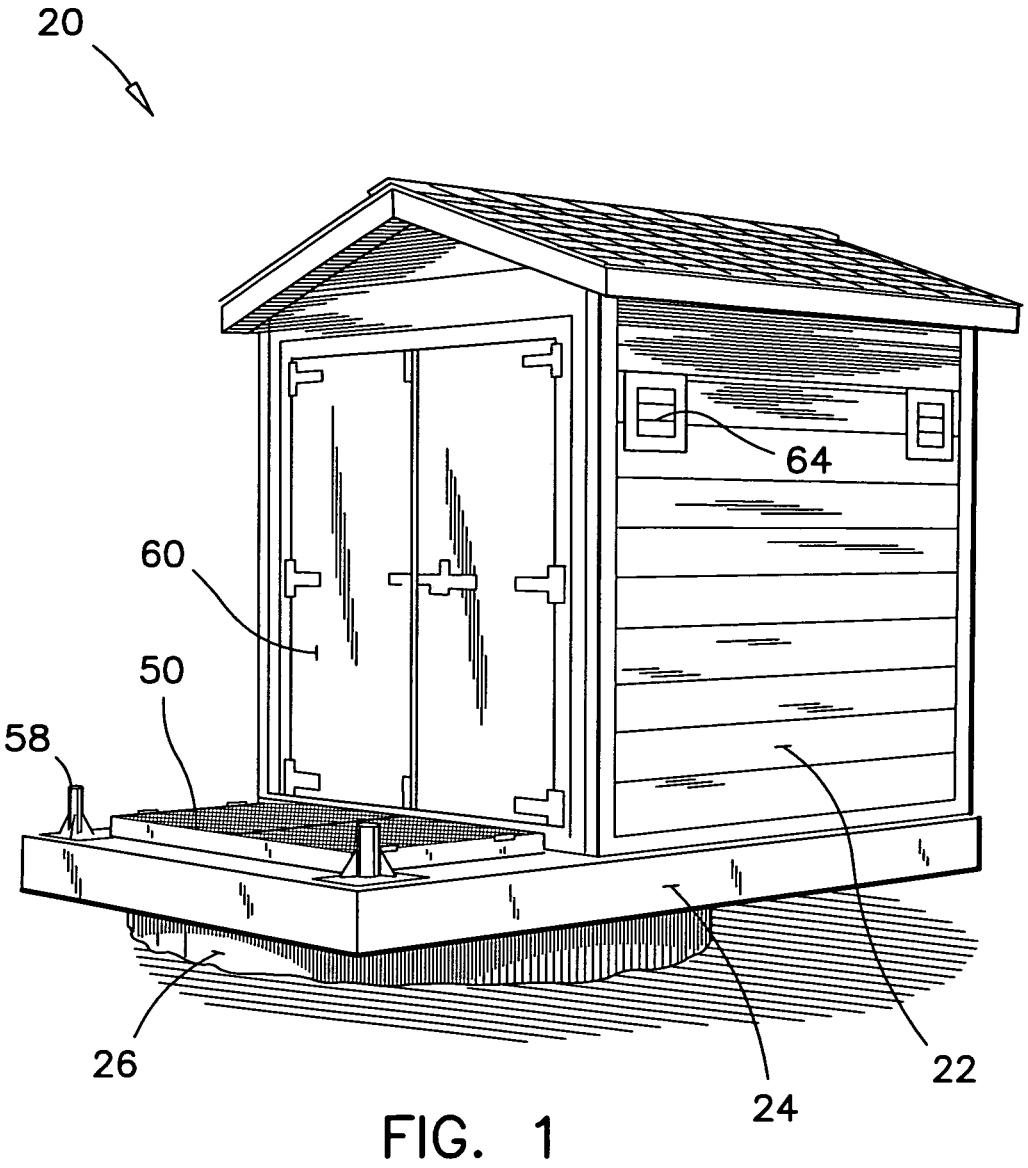
FIG. 1 is a perspective view of the prefab lift station according to the preferred embodiment of the present invention.

Referring firstly to FIG. 1 the prefab lift station 20 according to the preferred embodiment of the present invention is illustrated therein. The basic elements of the preferred prefab lift station 20, comprise an instrument building 22 that contains mechanical valves, gauges, metering equipment and electrical switches, and other electrical equipment. The instrument building 22 protects these equipment and instruments from the weather. This instrument building 22 is mounted over a concrete foundation slab 24. This foundation slab 24 is fitted to the upper rim of a well casing 26.

The instrument building 22 can have many shapes or forms. However, it is preferable that the instrument building 22 has a style and color that are compatible with the other buildings present in the immediate neighborhood of the lift station 20. A garden shed style has been illustrated in the accompanying drawings for convenience only. This preferred embodiment of the present invention is not limited to this style. A more neutral style is recommended for urban locations for example.

Figure 2:
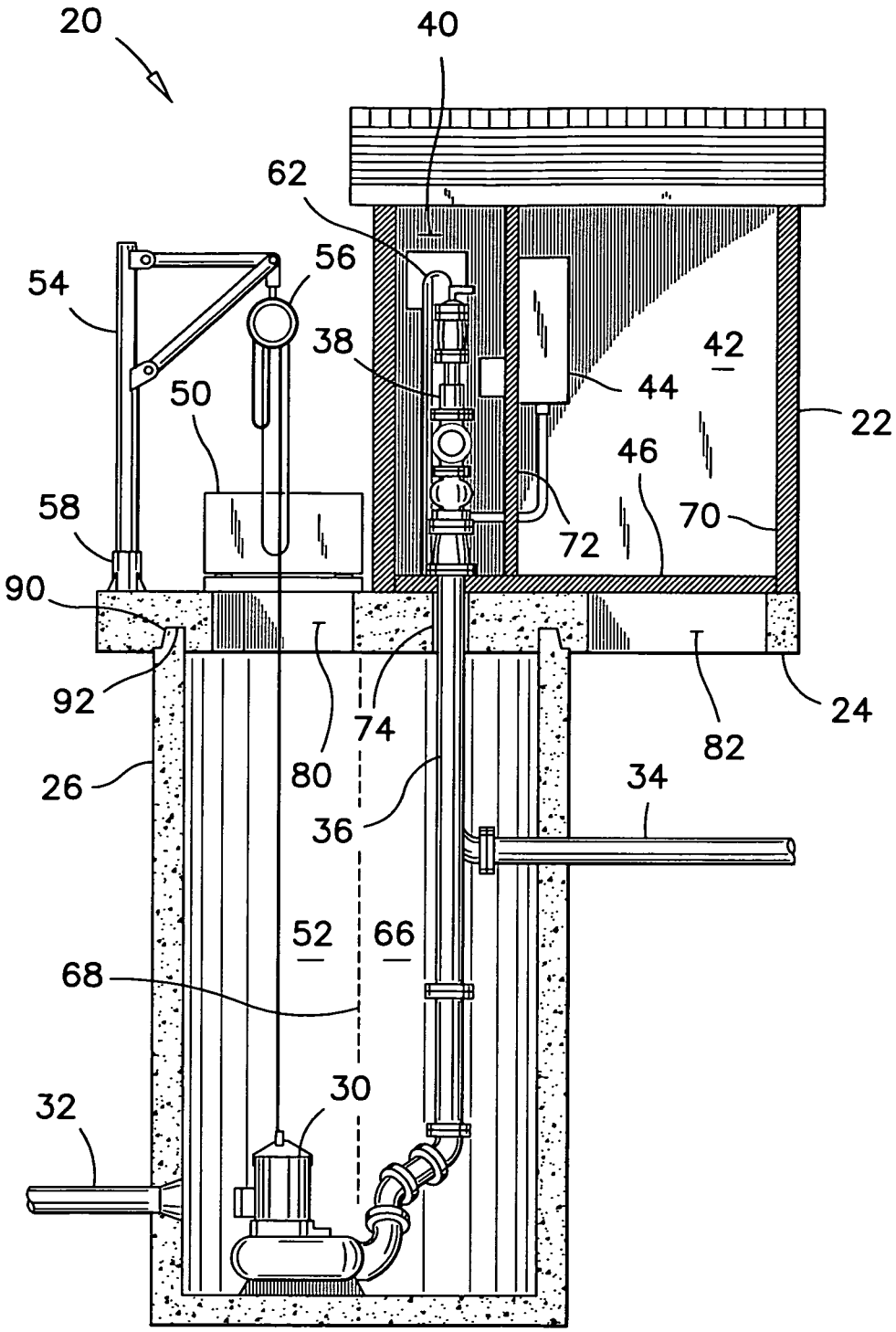
FIG. 2 is an elevation cross-section view of the preferred prefab lift station.

Referring to FIG. 2, further details about the preferred prefab lift station 20 will be provided. Firstly, a well casing 26 normally contains two submersible pumps 30 (only one is illustrated for clarity) that are operated in an alternating mode to pump sewage from one level 32 to a higher level 34. Piping 36 from the pumps 30 extends upward to aboveground mechanical equipment 38 including directional valves, check valves, air release valves, flow meter and pressure gauges.

In the preferred embodiment of the preferred invention, the instrument building 22 sits atop the well casing 26 so that the mechanical equipment 38 extends straight up from the well casing 26 into a front portion of the instrument building 22. This compartment of the instrument building 22 is referred to as the mechanical room 40. A rear portion of the instrument building is used as an electrical room 42. The electrical room 42 contains electrical switches, meters, transformers, timers and other electrical equipment and instrumentation 44 required for the operation of the lift station 20. The floor 46 of the instrument building 22 is preferably made of fiberglass to provide electrical insulation and protection against decay from humidity from the soil and from the liquid in the well.

The instrument building 22 is mounted offset from the center of the well casing 26, with the electrical room 42 overhanging the well casing 26. The electrical room 42 can be made to extend in an overhung mode to a sufficient dimension for allowing the provision of a comfortable-size walk-in space therein. The extent to which the electrical room 42 overhangs the well casing can be calibrated by the structure of the foundation slab 24 as this will be explained later.

The foundation slab 24 preferably overhangs the well casing 26 close to the soil surface so that the door 48 and doorsill of the electrical room 42 are accessible without difficulty.

This offset mounting of the building 22 provides a space in front of the instrument building 22 for an access hatch 50. The hatch 50 provide access into a first vertical half 52 of the well casing 26, as it can be seen in FIG. 2. The hatch 50 is accessible to install, service or to remove the pumps 30 from the well casing 26 using a crane 54 and hoist 56 for example. One or a pair of anchor sockets 58 are preferably provided on the foundation slab 24 near the hatch 50 to accommodate the mast of a crane 54 when required.

Figure 3:
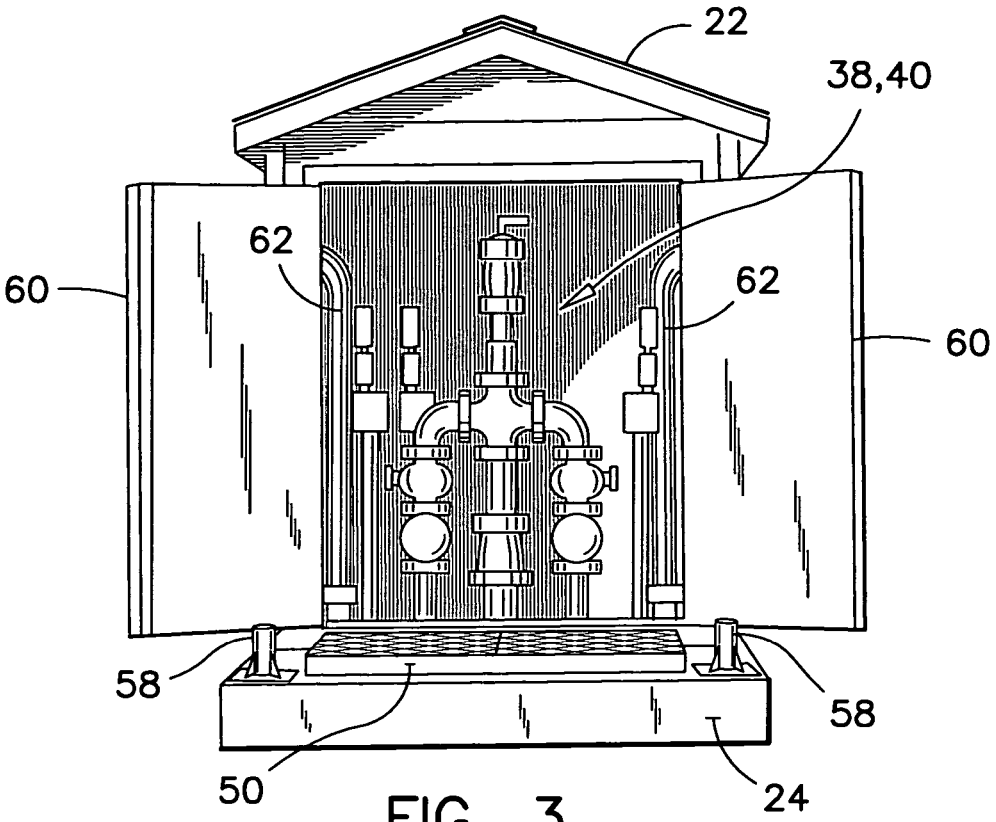
FIG. 3 is a front view of the instrument building and foundation slab of the preferred prefab lift station shown with the front doors open.
Figure 4:
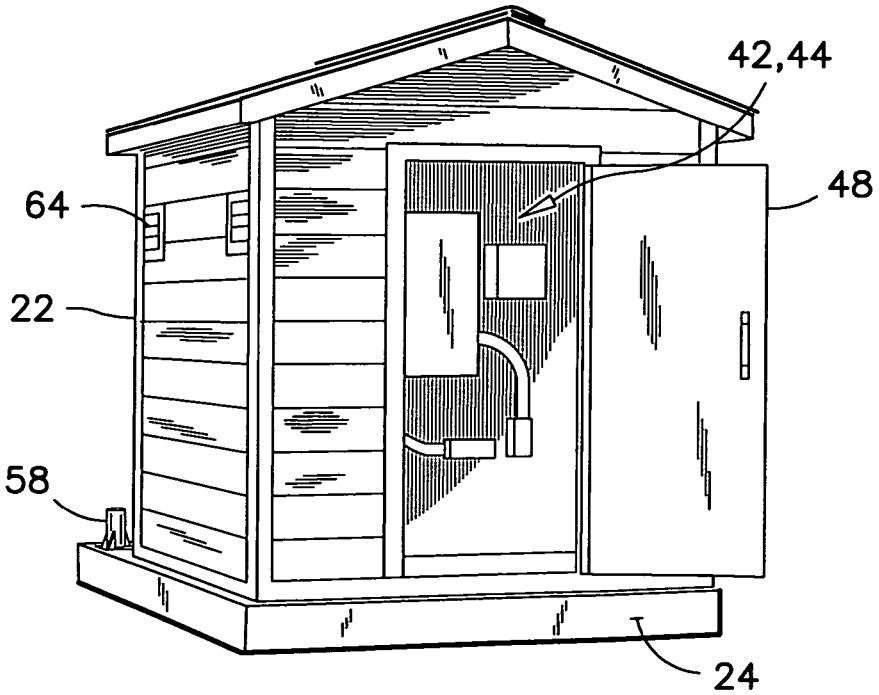
FIG. 4 is a perspective rear view of the instrument building of the preferred prefab lift station with the rear door open.

Referring now to FIGS. 3 and 4, the front wall of the instrument building 22 has doors 60 allowing access to the mechanical equipment 38 in that portion of the building 22. Also illustrated is a pair of ventilation ducts 62 extending from the well casing 26 below the foundation slab 24 to louvers 64 under the soffits of the instrument building 22. The mechanical room 40 is located above a second half 66 of the well casing 26, as it is illustrated in FIG. 2, on the right side of dashed line 68.

Referring back to FIG. 4, the rear wall of the instrument building 22 has the door 48 giving access to the electrical room 42 and the electrical equipment 44 inside that room 42.

Figure 5:
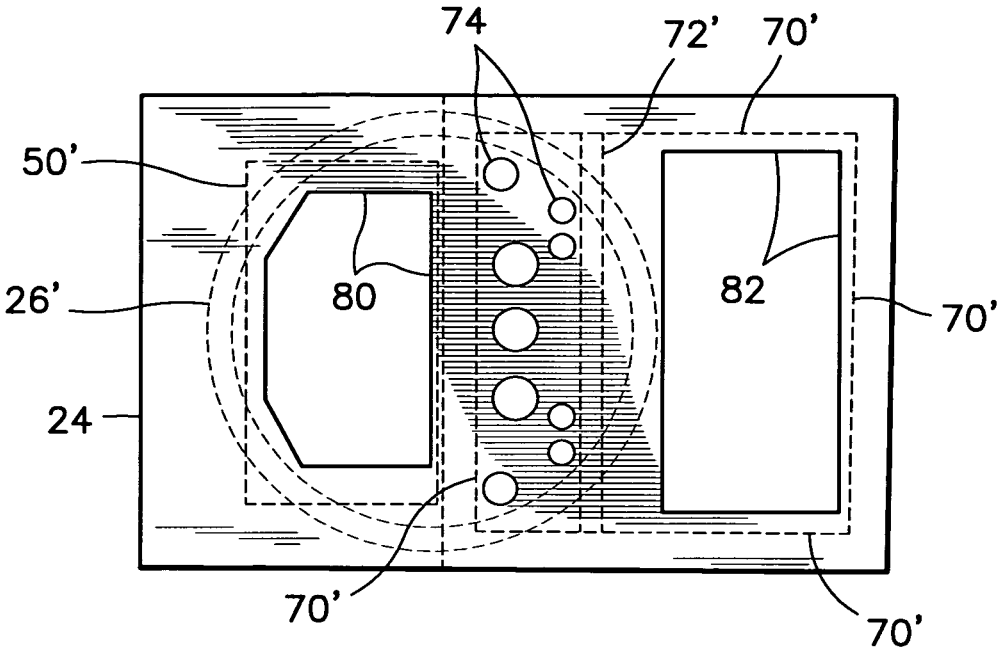
FIG. 5 is a plan view of the foundation slab of the preferred prefab lift station.
Figure 6:
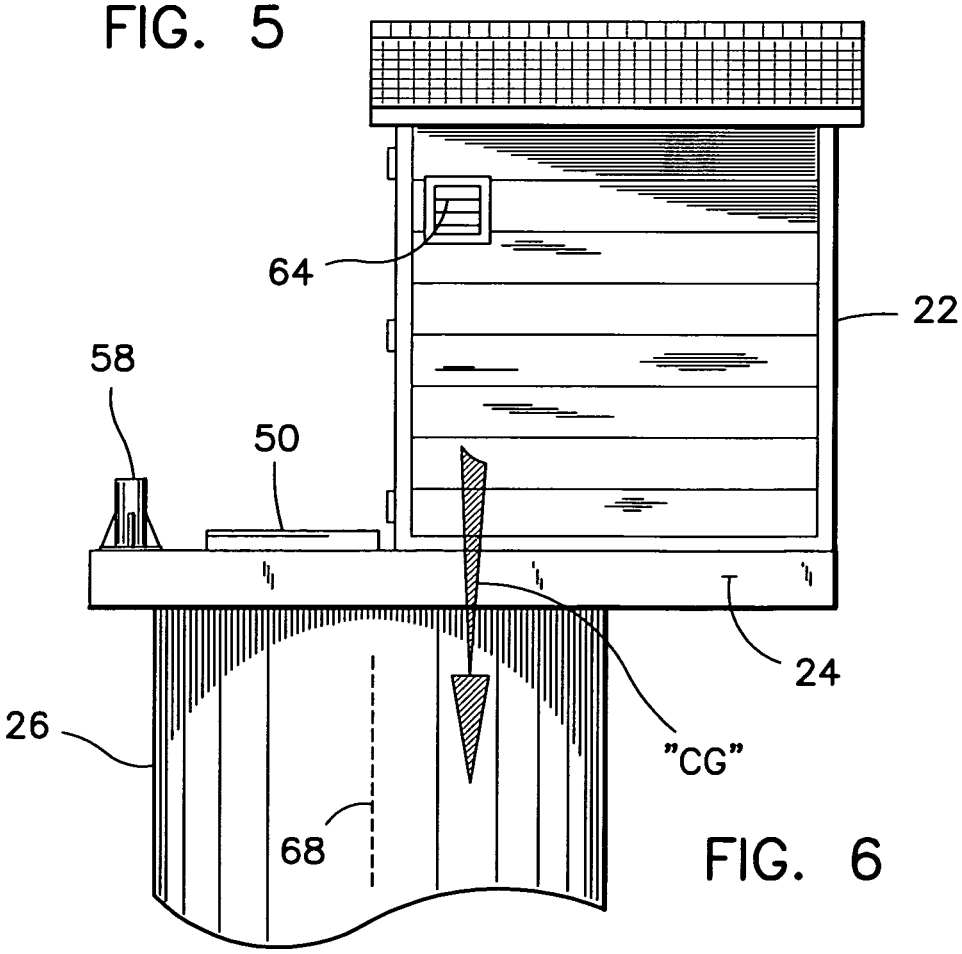
FIG. 6 is an elevation side view of the preferred prefab lift station.

Having described the general arrangement of the instrument building 22 and its content, reference is now made to the foundation slab 24 of the prefab lift station 20. Reference is now made to FIGS. 5 and 6 in the drawings. A plan view of the concrete foundation slab 24 in FIG. 5 shows a dashed-line rectangle 70'. This rectangle 70' represents the outline of the interior wall 70 of the instrument building 22.

The dashed lines 72' represent the partition 72 between the mechanical room 40 and the electrical room 42. A series of openings 74 are provided in the floor of the mechanical room 40 to accommodate the piping 36 of the mechanical equipment 38 and the electrical conduits for the electrical equipment 44. The dashed-line rectangle 50' represents the size of the hatch opening 50, and the dashed-line circles 26' represent the location of the well casing 26.

It will be appreciated from FIG. 6 that the electrical room 42 and the portion of the foundation slab 24 under the electrical room 42 overhang the rim of the well casing 26.

Back to FIG. 5, the open area 80 in the front portion of the foundation slab 24 is an opening through the foundation slab 24 giving access to the well casing 26 under the hatch 50. This relatively large opening 80 provides unrestricted access to accommodate the installation, maintenance or replacement of the equipment inside the well casing 26. The opening 80 is relatively large with its longer side bordering the diameter of the well casing 26, and its other sides bordering the rim of the well casing 26. The hatch opening 80 is nearly equivalent to one half of the cross-section of the well casing 26.

The open area 82 through the rear portion of the foundation slab 24 under the electrical room 42 constitutes a weightless volume. This weightless volume 82 is positioned and calibrated such as to shift the center of mass of the foundation slab 24, and the center of gravity "CG" of the foundation slab 24 with the instrument building 22 mounted on the slab 24. This weightless volume 82 is calibrated to move the center of gravity "CG" of the prefab lift station 20 to a region inside the well casing 26. Calibration of the self-balancing aspect of the preferred lift station 20 is done by adjusting the size of the weightless volume 82 or/and the thickness of the slab 24.

Although the weightless volume 82 is shown as an opening extending through the foundation slab 24, this weightless volume can extend only partly through the thickness of the foundation slab 24 and can have other shapes than rectangular. For example, the weightless volume 82 can be made out of one or more air pockets incorporated between the surfaces of the foundation slab 24.

Because of the overhanging slab 24 and the weightless volume 82 in the slab 24, the preferred lift station 20 can be mounted to the rim of a well casing 26 in a free standing mode, without requiring additional foundation work. The piping 36 and electrical conduits from the pumps 30 of the lift station 20 are easily installed straight up to the mechanical room 40 and to the electrical room 42. The well casing 26 does not require a separate cover. The foundation slab 24 constitutes a cover for the well casing 26.

Figure 7:
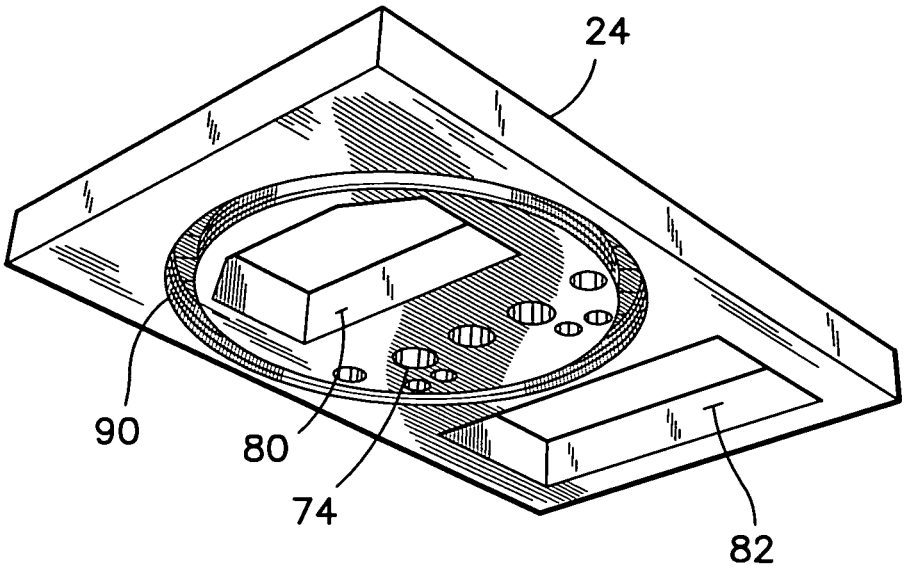
FIG. 7 is a perspective bottom view of the foundation slab of the preferred prefab lift station.
Figure 8:
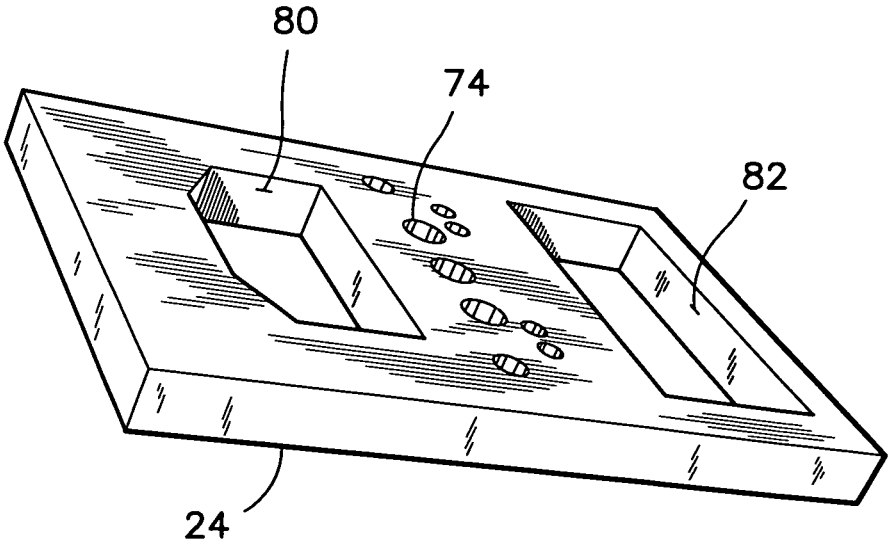
FIG. 8 is a is a perspective top view of the foundation slab of the preferred prefab lift station.

Referring now to FIG. 7, the underside of the slab 24 preferably has a circular groove 90 therein to fit over or to register with the horizontal upper rim 92 of the well casing 26 as it can be seen in FIG. 2. Grout or mortar may be used to seal the foundation slab 24 to the horizontal upper rim 92 of the well casing 26 but that is not absolutely required.

The foundation slab 24 is preferably built precast with high strength concrete and reinforcement. Hooks in each corner (not shown) may be provided for lifting the slab 24 and to move it in place.

Although a circular well casing 26 has been described and illustrated herein, it will be appreciated that other shapes are also compatible for inclusion into other embodiments of the present invention. Well casing having a square, rectangular or other polygonal cross-section can also be used with the foundation slab 24 and instrument building 22 described herein. The foundation slab 24 may be mounted on a square or rectangular septic well casing for example. Therefore, the present invention is not limited to circular well casings. Similarly, the foundation slab 24 may have other shape than rectangular, and such rectangular shape as illustrated should not be limiting the present invention.

While one embodiment of the present invention has been illustrated in the accompanying drawings and described herein above, it will be appreciated by those skilled in the art that various modifications, alternate constructions and equivalents may be employed. Therefore, the above description and illustrations should not be construed as limiting the scope of the invention, which is defined in the appended claims.

What is claimed is:

1. A prefab lift station comprising:

a well casing including mechanical equipment therein and a horizontal upper rim;

a one-piece foundation slab mounted to said horizontal upper rim covering said well casing; said one-piece foundation slab being larger in surface area than a cross-sectional area of said well casing; a portion of said one-piece foundation slab overhanging said well casing horizontally aboveground to one side of said well casing, outside said horizontal upper rim;

a building mounted to said one-piece foundation slab, said building being larger in floor area than said cross-sectional area of said well casing; said building being mounted to said one-piece foundation slab such that said building only partly covering said cross-sectional area of said well casing, with a first building portion thereof being located immediately above said well casing, and another building portion thereof being overhung to said one side of said well casing, outside said horizontal upper rim; and a hatch located aboveground in said foundation slab outside and in front of said building, said hatch having a first opening giving access to a first vertical half of said well casing; said first opening having one side bordering a diameter of said well casing;

said foundation slab having a weightless volume incorporated therein; said weightless volume being located under said another portion of said building, shifting a combined center of gravity of said one-piece foundation slab and of said building from said one side of said well casing to a region inside said horizontal upper rim.

2. The prefab lift station as claimed in claim 1, wherein said weightless volume is an opening through said foundation slab.

3. The prefab lift station as claimed in claim 1 wherein said foundation slab has a circular groove in a bottom surface thereof registering with said horizontal upper rim of said cylindrical well casing.

4. The prefab lift station as claimed in claim 1, wherein said well casing is cylindrical.

5. The prefab lift station as claimed in claim 1, wherein said building has a center of volume located outside said horizontal upper rim.

* * * * *